United States Patent [19]

Burn

[11] Patent Number: 4,499,742

[45] Date of Patent: Feb. 19, 1985

[54] CREW SOCK WITH NONROLL SELVAGE TOP

[75] Inventor: William H. Burn, Niota, Tenn.

[73] Assignee: Crescent Hosiery Mills, Niota, Tenn.

[21] Appl. No.: 354,661

[22] Filed: Mar. 4, 1982

[51] Int. Cl.[3] ..... D04B 9/24; D04B 9/46

[52] U.S. Cl. ..... 66/172 E

[58] Field of Search ..... 66/136, 172 E, 178 R, 66/180, 182, 183, 185; 2/240

[56] References Cited

U.S. PATENT DOCUMENTS

| | | | |
|---|---|---|---|
| Re. 24,384 | 10/1957 | Elder et al. | 66/172 E |
| 2,139,606 | 12/1938 | Scholz | 66/172 E |
| 2,256,691 | 9/1941 | Smith, Jr. | 66/172 E |
| 3,078,697 | 2/1963 | Johnson | 66/172 E X |
| 3,828,585 | 8/1974 | Thorneburg | 66/180 X |
| 3,990,115 | 11/1976 | Nester | 66/172 E X |
| 4,326,393 | 4/1982 | Dunlap | 66/172 E |

*Primary Examiner*—Wm. Carter Reynolds

*Attorney, Agent, or Firm*—Bell, Seltzer, Park & Gibson

[57] ABSTRACT

The nonroll selvage of the crew or athletic sock includes a plurality of rounds of polyurethane elastic yarn and a single course of plain stitch loops knit solely of a stretchable yarn to form single yarn stretchable stitch loops alternately positioned in front of and behind the rounds of polyurethane elastic yarn. The stretchable yarn connecting the upper ends of adjacent stitch loops of this single course passes over and surrounds the rounds of polyurethane elastic yarn in contracted condition so that the rounds of polyurethane elastic yarn are drawn together and held closely against the first course of the portion of the leg adjacent the nonroll selvage to provide a small upstanding bead extending around the upper end of the sock.

6 Claims, 2 Drawing Figures

CREW SOCK WITH NONROLL SELVAGE TOP

FIELD OF THE INVENTION

This invention relates generally to a sock with a nonroll selvage and more particularly to a crew or athletic type sock in which the nonroll selvage is formed by a plurality of rounds of polyurethane elastic yarn and a single course of stitch loops knit of a stretchable yarn so that the rounds of polyurethane elastic yarn are drawn together and held closely adjacent the first course of the adjacent leg portion to provide a small upstanding bead extending around the upper end of the sock.

BACKGROUND OF THE INVENTION

It is the usual practice to form the selvage or makeup of a sock by inlaying a plurality of rounds of polyurethane elastic yarn on the needles of a circular hosiery knitting machine and then knitting a course of body yarn so that the stitch loops are alternately positioned in front of and behind the rounds of elastic yarn and the yarns connecting the upper ends of these adjacent stitch loops pass over and surround the rounds of elastic yarn. When the first course is knit of a nonstretchable yarn or of stretchable and nonstretchable yarn, the nonstretchable yarn is loosely looped around the rounds of elastic yarn. The rounds of elastic yarn are inlaid under tension and tend to cause the top or selvage of the sock to roll or curl outwardly and the loose loops of nonstretchable body yarn surrounding the rounds of elastic yarn cause the selvage to have an uneven and unsightly appearance. This rolling or curling of the selvage of the sock has been a long-standing problem and various proposals have been made in an attempt to correct this problem.

Most of these proposed solutions have included the knitting of either held or tuck loops in the first course and these held or tucked loops are formed for the purpose of drawing the rounds of elastic yarn together and inwardly against the upper edge of the leg of the sock. However, the held or tuck loops actually cause the upper edge of the sock to tend to roll outwardly and the plain stitch loops formed therebetween protrude outwardly from the selvage edge to form a ragged appearance. Also, the formation of held or tucked loops in the first course of the makeup requires the use of special patterning in the knitting machine and may cause a different appearance in the makeup or selvage. For example, U.S. Pat. No. 4,109,492 discloses two embodiments of a sock selvage in which held loops are formed in spaced wales of the first few courses of the makeup. Another embodiment of the sock of this patent includes tuck loops formed in spaced wales of the first few courses of the makeup.

U.S. Pat. No. 2,731,819 discloses the successive formation of both tuck and held loops in spaced wales in the first few upper courses of the selvage of the sock. U.S. Pat. No. 2,247,343 discloses the formation of successive series of tuck loops in spaced wales of the first few courses of the selvage. U.S. Pat. No. 2,139,606 discloses the formation of held loops in spaced wales in the first few courses of the selvage.

SUMMARY OF THE INVENTION

With the foregoing in mind, it is an object of the present invention to provide crew or athletic type socks with a nonroll selvage or makeup which does not require the use of special held or tuck loops and which provides a small upstanding and neat appearing bead extending around the upper end of the sock.

In accordance with the present invention, the nonroll selvage includes a plurality of rounds of polyurethane elastic yarn and a single course of plain or jersey stitch loops knit solely of a stretchable yarn to form single yarn stitch loops alternately positioned in front of and behind the rounds of polyurethane elastic yarn. The yarn connecting the upper ends of adjacent stitch loops passes over and surrounds the rounds of polyurethane elastic yarn so that the rounds of polyurethane elastic yarn are drawn together and held closely against the first course of the portion of the leg adjacent the nonroll selvage to provide a small upstanding bead extending around the upper end of the sock.

The nonroll selvage of the present invention is formed on crew or athletic socks of the type in which the leg portion is knit with a nonstretchable bulky body yarn, such as spun Orlon and a stretchable auxiliary yarn, such as textured nylon in plated relationship to form double yarn stitch loops in each course of the leg. The present nonroll selvage includes a plurality of rounds of polyurethane elastic yarn with a single course of plain stitch loops knit solely of the stretchable yarn to form single yarn stretchable stitch loops. Portions of the stretchable stitch loops pass over and surround the rounds of polyurethane elastic yarn while the bulky nonstretchable body yarn is excluded from the single course of the selvage and is knit in plated relationship with the stretchable auxiliary yarn in the first and subsequent courses of the leg of the sock. The elimination of the bulky nonstretchable body yarn from the single course of the selvage also reduces the size and bulk of the single yarn stitch loops surrounding the rounds of polyurethane elastic yarn and this size reduction aids in the prevention of the rolling or curling of the selvage.

BRIEF DESCRIPTION OF THE DRAWINGS

Some of the objects and advantages of the invention having been stated, other objects and advantages will appear as the description proceeds, when taken in connection with the accompanying drawings, in which.

DESCRIPTION OF THE ILLUSTRATED EMBODIMENT

Figure 1:
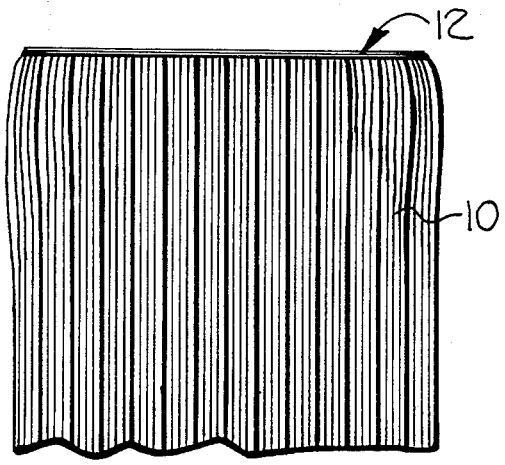
FIG. 1 is a fragmentary elevational view of the upper portion of the leg of a sock and showing the nonroll selvage of the present invention associated therewith.
Figure 2:
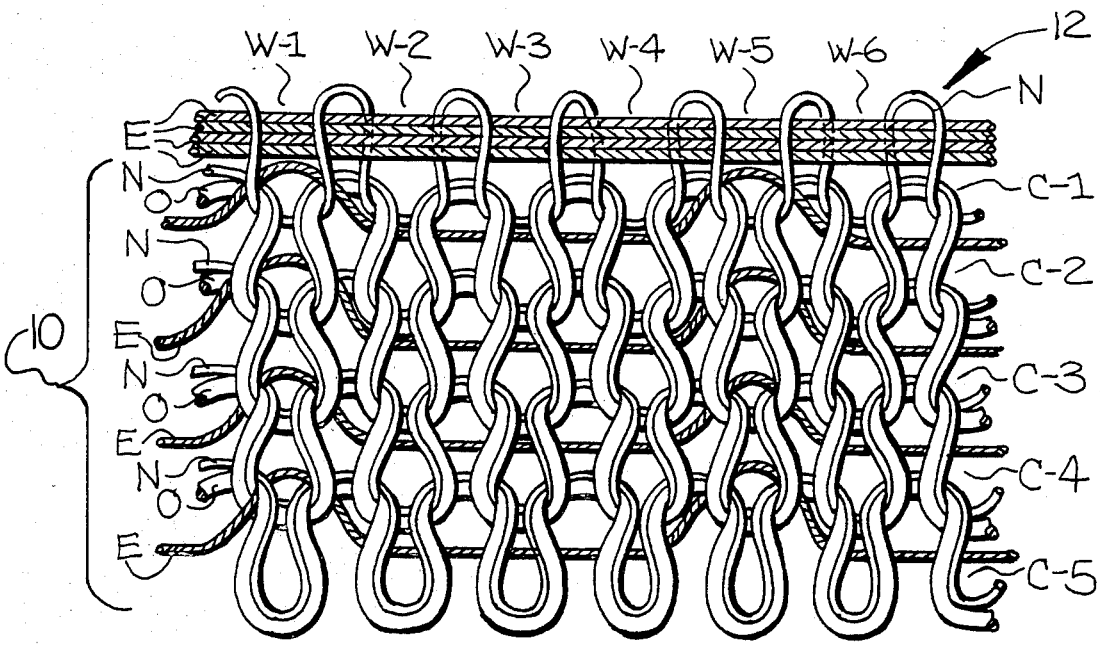
FIG. 2 is a greatly enlarged view of a few wales and courses of the upper portion of FIG. 1 and with the yarns being shown in relaxed or untensioned condition for purposes of clarity.

The upper or top portion of the leg 10 of a sock is shown in FIG. 1 with the nonroll selvage 12 of the present invention applied to the upper edge thereof. In this particular sock, the leg 10 is of a mock rib construction and, as illustrated in the courses C-2 through C-5 in FIG. 2, is knit with plain or jersey stitch loops in wales W-1 through W-6. The leg 10 is knit with a bulky nonstretchable body yarn O and a stretchable auxiliary yarn N in plated relationship to form double yarn stitch loops in each course. A polyurethane elastic yarn E is incorporated, as by inlaying in a three-by-one manner, in each of the courses in the leg 10. The polyurethane elastic yarn E is striped in FIG. 2 to aid in identifying it in the knit fabric. The stretchable yarn N is textured nylon and is illustrated as being smaller than the nonstretchable body yarn O, which is spun Orlon. While the leg 10 of the sock is illustrated as being formed with a three-by-one mock rib, it is to be understood that the leg of the sock may be plain or formed in any other conventional manner. The elastic yarn E can be incorporated by inlaying in every course, as illustrated, or the elastic yarn E can be incorporated by knitting and floating in every course or in spaced-apart courses.

The nonroll selvage or makeup 12 of the present invention, as shown in FIG. 2, includes a plurality of rounds of polyurethane elastic yarn E, illustrated as four rounds, and a single course (Course C-1) of plain or jersey stitch loops knit solely of the stretchable yarn N to form single yarn stretchable stitch loops in each of the wales W-1 through W-6. The lower ends of the single yarn stretchable stitch loops of the single course C-1 are joined to the upper ends of the double yarn stitch loops of the first course C-2 of the portion of the leg 10 which is positioned adjacent the nonroll selvage.

The single yarn stretchable stitch loops of the single course C-1 are alternately positioned in front of (wales W-1, W-3 and W-5) and behind (wales W-2, W-4 and W-6) the rounds of elastic yarn E. The yarn which connects the upper ends of adjacent stitch loops of course C-1 passes over and surrounds the rounds of elastic yarn E. The stretchable textured nylon yarn N is illustrated in course C-1 of FIG. 2 in a loose or unstretched condition for purposes of clarity. However, it is to be understood that this yarn N actually contracts and surrounds the elastic yarns in a tight manner so as to draw the rounds of elastic yarn together and hold them closely against the first course of the portion of the leg 10 adjacent the nonroll selvage 12 (course C-2) to provide a small upstanding bead extending around the upper end of the sock.

METHOD OF KNITTING

The nonroll selvage 12 and the leg 10 of the sock are knit in the usual manner except that the single course (course C-1) of the nonroll selvage 12 is knit solely of the stretchable yarn N and the knitting of the body yarn O does not begin until the knitting of the first course of the leg 10 (course C-2). The inlaying of the rounds of elastic yarn E is accomplished on the conventional type of hosiery knitting machine by selecting every other needle to be raised to pick up the elastic yarn E in the hook side thereof while the remaining needles remain in a lowered position. The needles are raised when they pass the main knitting station so that the rounds of elastic yarn E are interlaced with the needles, the rounds of elastic yarn E being positioned on the hook side of every other needle and floated across the inside of the remaining needles.

After the elastic yarn E has been inlaid for four rotations of the needle cylinder, the yarn feed finger containing the stretchable auxiliary body yarn N is lowered to the normal yarn feeding position. The yarn N is picked up and knit by every needle and to form the plain or jersey stitch loops positioned alternately and in front of and behind the rounds of elastic yarn, as illustrated in course C-1 of FIG. 1. During the next and subsequent rotations of a needle cylinder, the elastic yarn is fed to every fifth needle (the needles which form the wales W-1 and W-5) while both the body yarn O and the stretchable auxiliary yarn N are fed to and form plain or jersey stitch loops on every needle to form the plain knit double yarn courses throughout the leg 10, as illustrated in courses C-2 through C-5 with the elastic yarn E forming floats inside of the three wales therebetween. When the fabric is relaxed, the elastic floats draw the fabric together and push the three wales outwardly to thus provide the mock rib appearance.

The stretchable yarn N forming the stitch loops in the course C-1 of the nonroll selvage 12 contracts as soon as the stitch loops are shed from the needles so that the yarn connecting the upper ends of adjacent stitch loops draws the rounds of elastic yarn E closely together and holds them closely against the first course of the portion of the leg adjacent the nonroll selvage 12. This drawing together of the rounds of elastic yarn E provides a very small and neat appearing bead extending around the upper end of the sock.

If the body yarn O and the stretchable auxiliary yarn N were both knit together in the first course C-1, as is the usual practice, the stretchable yarn N would still contract but the nonstretchable yarn O would not contract and form loops loosely surrounding the elastic rounds E to provide an uneven and unsightly appearance on the selvage of the sock. By eliminating the nonstretchable body yarn O from the first course C-1 of the nonroll selvage 12, the stretchable auxiliary yarn N contracts around the elastic rounds E and provides a very small and tight nonroll selvage 12 at the upper end of the sock.

In most crew or athletic type socks the mock rib leg extends from the open upper end or selvage to a point closely adjacent the foot. However, in some socks the mock rib portion is only formed in an area of from one to three inches below the selvage to provide a "cuff" at the upper end of the leg. While the present nonroll selvage has been described as being provided on a sock having a mock rib leg, it is to be understood that the present nonroll selvage can also be used on a sock formed with a mock rib cuff.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. In a sock of the crew or athletic type including a leg and wherein said leg includes successive courses knit with a nonstretchable body yarn and a textured stretchable auxiliary yarn in plated relationship to form double yarn stitch loops, and a polyurethane elastic yarn incorporated in certain courses of said double yarn stitch loops, the combination therewith of a nonroll selvage comprising a plurality of rounds of polyurethane elastic yarn, and a single course of plain stitch loops knit solely of said textured stretchable yarn to form single yarn stretchable plain jersey stitch loops in every wale, the lower ends of the single yarn stretchable plain jersey stitch loops of said single course being joined to the upper ends of the double yarn stitch loops of the first course of the portion of said leg adjacent said nonroll selvage, and single yarn stretchable plain jersey stitch loops of said single course being alternately positioned in front of and behind said rounds of polyurethane elastic yarn with said textured stretchable yarn connecting the upper ends of adjacent stitch loops surrounding and passing over said rounds of polyurethane elastic yarn in contracted condition so that said rounds of polyurethane elastic yarn are drawn together and held closely against the double yarn stitch loops of the first course of the portion of said leg adjacent said nonroll selvage to provide a small upstanding bead extending around the upper end of said sock.

2. A sock according to claim 1 wherein said elastic yarn is incorporated in said certain courses by being inlaid therein.

3. A sock according to claim 2 wherein said elastic yarn is inlaid in a three-by-one manner.

4. A sock according to claim 1 wherein said nonroll selvage comprises four rounds of elastic yarn.

5. A sock according to claim 1 wherein said stretchable yarn of said single course of said nonroll selvage is textured nylon.

6. In a sock of the crew or athletic type including a leg and wherein said leg includes successive courses knit with a nonstretchable body yarn and a textured a stretchable auxiliary yarn in plated relationship to form double yarn stitch loops, the combination therewith of a nonroll selvage comprising a plurality of rounds of a polyurethane elastic yarn, and a single course of plain stitch loops knit solely of said textured stretchable yarn to form single yarn stretchable plain jersey stitch loops in every wale, the lower ends of the single yarn stretchable plain jersey stitch loops of said single course being joined to the upper ends of the double yarn stitch loops of the first course of the portion of said leg adjacent said nonroll selvage, said single yarn stretchable plain jersey stitch loops of said single course being alternately positioned in front of and behind said rounds of polyurethane elastic yarn with said textured stretchable yarn connecting the upper ends of adjacent stitch loops surrounding and passing over said rounds of polyurethane elastic yarn in contracted condition so that said rounds of polyurethane elastic yarn are drawn together and held closely against the double yarn stitch loops of the first course of the portion of said leg adjacent said nonroll selvage to provide a small upstanding bead extending around the upper end of said sock.

* * * * *